United States Patent [19]

Peter

[11] Patent Number: 4,924,638

[45] Date of Patent: May 15, 1990

[54] DOMED SUPPORT STRUCTURE

[76] Inventor: Emil Peter, Dammweg, 8460 Marthalen, Switzerland

[21] Appl. No.: 231,312

[22] Filed: Aug. 11, 1988

[30] Foreign Application Priority Data

Aug. 12, 1987 [CH] Switzerland ..... 3104/87

[51] Int. Cl.[5] ..... E04B 7/12

[52] U.S. Cl. ..... 52/86; 52/18; 52/644

[58] Field of Search ..... 52/86, 18, 644

[56] References Cited

U.S. PATENT DOCUMENTS 4,357,782 11/1982 Peter ..... 52/86

4,471,585 9/1984 Peter ..... 52/86

*Primary Examiner*—John E. Murtagh

*Attorney, Agent, or Firm*—Diller, Ramik & Wight

[57] ABSTRACT

In a domed support structure, especially for roof construction, a compression dome is arched in lengthwise direction in a catenary configuration. A tension dome is further arranged either side by side or below the compression dome and is also arched in lengthwise direction in a catenary configuration. The compression and the tension domes are provided with a compression sheating and a tension sheating, respectively. The compression sheating is formed to have a high buckling strength. To this end the compression sheating is arched also in a direction transverse to said lengthwise direction. The arched shape is defined and maintained by corresponding transverse beams which function as stiffening or shaping elements but do not support any load caused by the own weight of the sheating. Such forces are transmitted by the sheating itself directly onto the bearings of the structure at its lengthwise ends. Thereby, the weight forces are equally distributed over the entire structure instead of being concentrated in a few beams or girders. The elements of the structure therefore can have relatively small cross sections and weights. Especially, wooden elements can be used for building the domed support structure of the invention.

6 Claims, 4 Drawing Sheets

FIG. 5
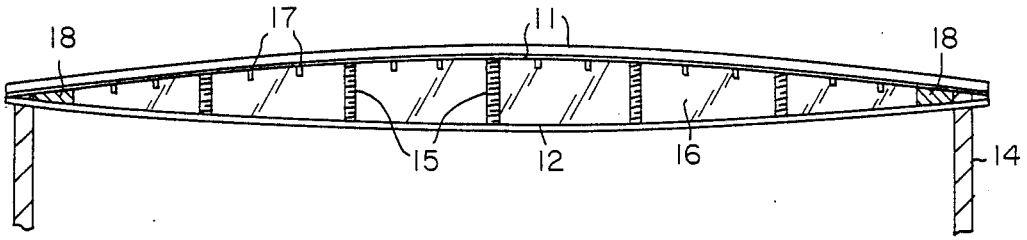
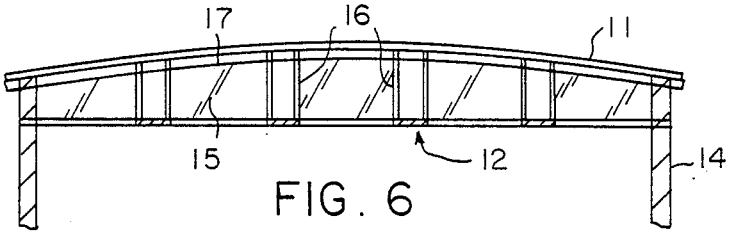
FIG. 6
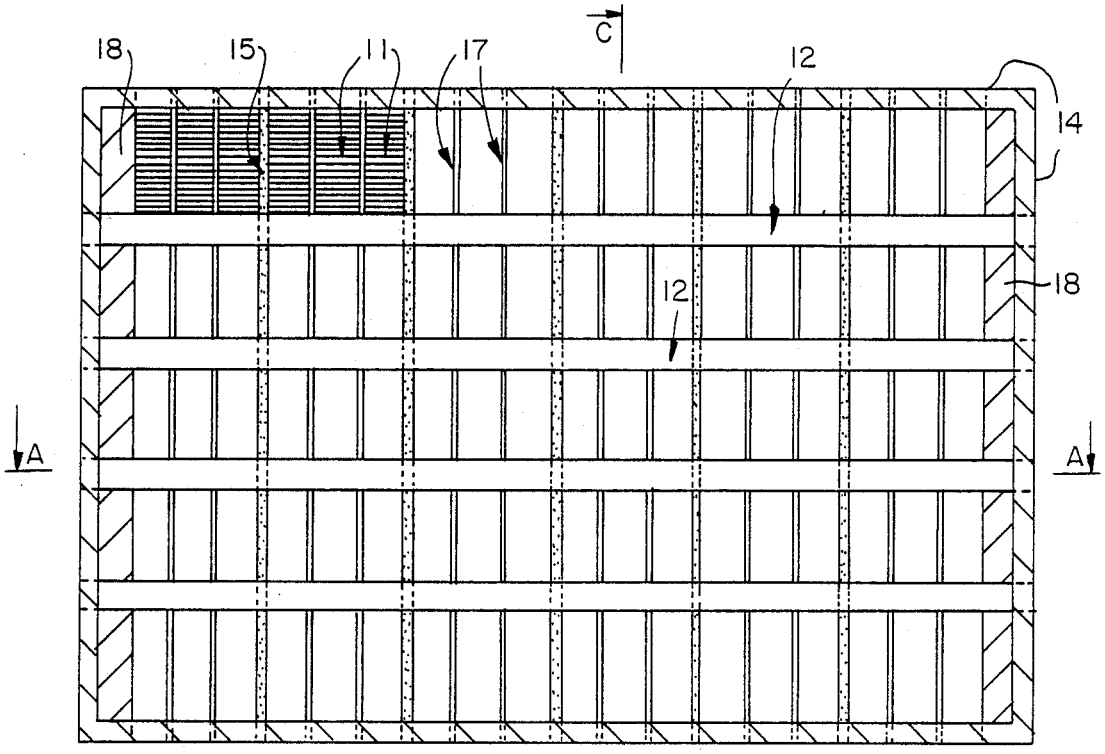
FIG. 4

DOMED SUPPORT STRUCTURE

BACKGROUND OF THE INVENTION

The invention refers to a new and improved construction of an arched or domed support structure of wooden or steel elements, especially for roof constructions, which is of the type comprising a compression dome arched in lengthwise direction in a catenary configuration and comprising bearings at least at the lengthwise ends of said compression dome on which said dome is supported.

A structure of the aforementioned type has been disclosed e.g. in U.S. Pat. No. 4,471,585 by the applicant. Therein tension domes and compression domes are arranged adjacent to each other in the arching direction and tension elements are provided to transmit the tension forces of the tension domes into the adjacent compression domes. The weight of the structure itself and of the loads is concentrated in lengthwise extending structural elements and is transmitted by them in lengthwise direction to said tension elements in order to be absorbed therein. Therefore, high connection forces be avoided between the structural elements of the known structure.

Due to this in the aforementioned structure, structural elements are needed with a relative large cross section which in turn increases their weight and the weight of the entire structure. Consequently, structures of the aforementioned type are not suited for being built of wooden elements or steel elements having small cross sections. As to wooden elements, it is well known in the art that it is difficult to provide safe connections between such elements for higher loads. But even if wooden girders of large cross section are used, higher loads inevitably lead to deformations of their interconnections and consequently of the entire structure.

However, it is also known in the art that wooden elements of smaller cross sections and for smaller loads can safely be interconnected without any deformation problem.

SUMMARY OF THE INVENTION

Therefore, it is a primary object of the present invention to provide a domed support structure of the aforementioned type, in which the connection forces between the elements of the structure can be kept as low as possible, so that the structure can be built of wooden or steel elements of small cross section.

Now in order to implement this and still further objects of the invention which will become more readily apparent as the description proceeds, the invention contemplates that the compression dome comprises a compression sheating which in lengthwise direction has a catenary shape and which in addition either is arched in a direction transverse to said lengthwise direction or is profiled in lengthwise direction the invention further comprises stiffening or shaping elements extending in lengthwise and in transverse direction, which stiffening or shaping elements are substantially unloaded by the weight of said compression sheating itself and, said sheating transmits its own weight directly to the bearings of the support structure distributed at least over its extension transverse to the longitudinal direction.

Said sheating, which by said stiffening elements is kept in an arched shape in two directions or which is profiled and kept in an arched shape in lengthwise direction, thereby can be formed by elements of small cross sections and low weight. Consequently, the connecting forces can be kept low, which allows the use of wooden elements for said compression sheating. The weight of the compression sheating itself is distributed over the entire extension of the domed support structure, so that any concentration of forces can be avoided. Large cross sections for said elements are therefore no longer necessary.

BRIEF DESCRIPTION OF THE DRAWINGS

The invention will be better understood and objects other than those set forth above will become apparent when consideration is given to the following detailed description thereof. Such description makes reference to the annexed drawings, wherein:

FIG. 4 is a bottom plan view of a second embodiment of a domed support structure according to the invention;

FIG. 5 is a longitudinal sectional view through the domed support structure of FIG. 4 substantially taken along the line A—A in FIG. 4;

FIG. 6 is a transverse sectional view through the domed support structure of FIG. 4 substantially taken along the line C—C in FIG. 4;

DETAILED DESCRIPTION OF THE PREFERRED EMBODIMENTS

Figure 3:
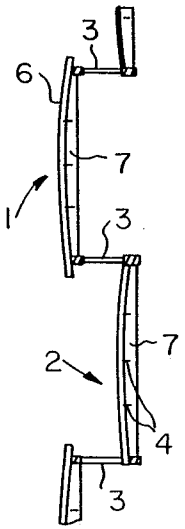
FIG. 3 is a transverse sectional view through the domed support structure of FIG. 1 substantially taken along the line E—E in FIG. 1.
Figure 1:
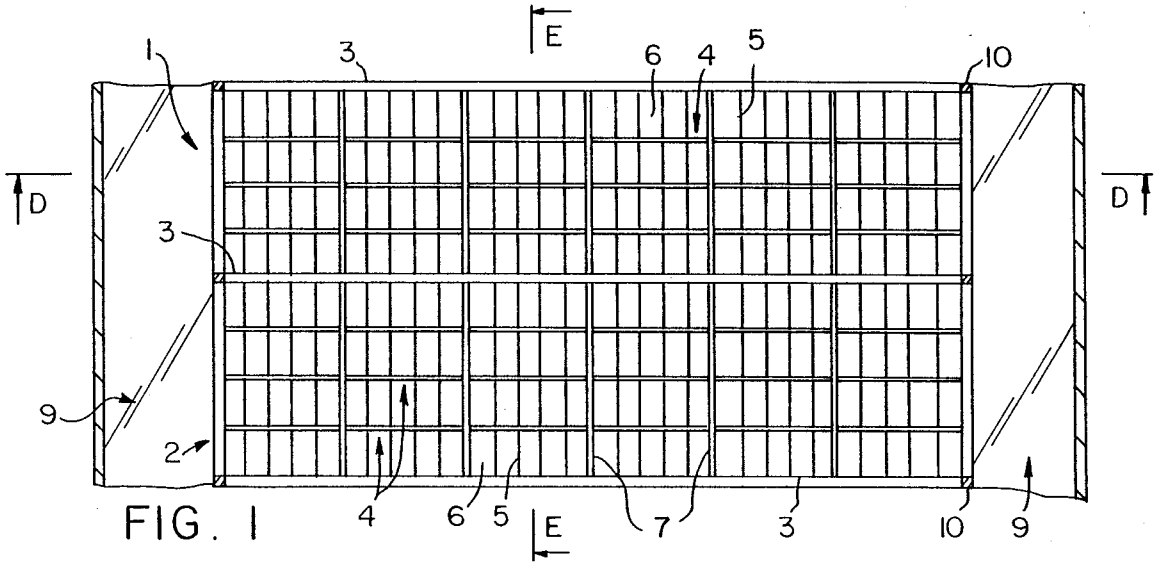
FIG. 1 is bottom plan view of a first embodiment of a domed support structure according to the invention.
Figure 2:
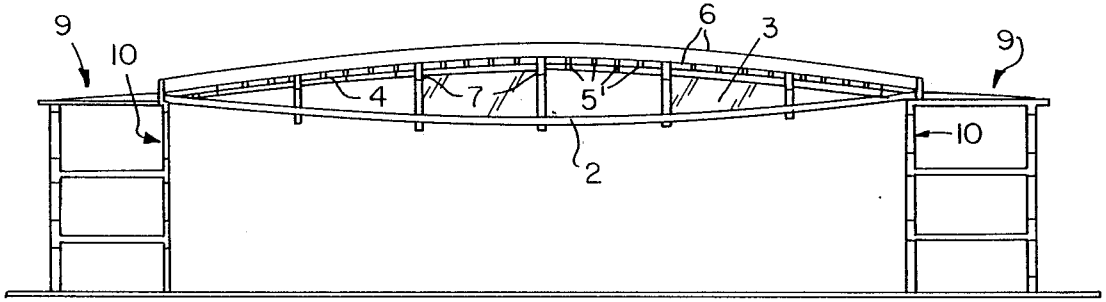
FIG. 2 is a longitudinal sectional view through the support structure of FIG. 1 substantially taken along the line D—D in FIG. 1.

Describing now the drawings, we first turn to FIGS. 1 to 3, illustrating a first embodiment of the invention in the form of a hangar. The domed support structure is composed of compression domes 1 and adjacent tension domes 2, which are connected by means of girder elements 3. Said girder elements 3 substantially do not support the weight of the compression and the tension domes but are provided to define the shape of the domes and to transmit unequal loads between them. Each of the compression domes 1 and tension domes 2 comprises rafters 4 extending in a longitudinal direction which are connected to each other by transverse bars 5, and which in turn are connected to a domed sheating 6. The longitudinal rafters 4 extend in a catenary shape, as can best be seen from FIG. 2. In transverse direction purlins 7 extend between said girder elements 3 having the function to define and maintain an arched shape of the domed sheating in transverse direction. As can be seen from FIG. 3, the upper "surfaces" of the purlins 7 define the curvature of the sheating in transverse direction. This curvature or arched shape of the sheating 6 in transverse direction results in a stiffening of the sheating in the longitudinal direction, whereby the buckling strength of the structure is increased in this direction. The purlins 7 and the girder elements 3 substantially are not loaded by the weight of the sheating 6, but are mainly provided for the stability of the shape of the domed support structure. Therefore the cross section of these elements can be relatively small. The weight of the domed sheating 6 itself is transmitted by the sheating itself of the compression and the tension domes, respectively, and by the rafters 4 on the shortest path to the bearings 10 of the structures. The girder elements 3 therefore do not have to support excessive load. They merely have to absorb and transmit unequally distributed net loads caused e.g. by the influence of wind or the weight of snow or water. In the embodiment of the FIGS. 1 to 3 the domed sheating is formed by wooden boards, which are connected to each other by means of nail connections as e.g. sheet metal plates nailed across the joint abutment of the boards. The domed sheating, however, can as well be formed by steel profile elements.

At their ends in the longitudinal direction the domed sheatings 6 of the compression dome 1 and of the tension dome 2 are anchored in a steel concrete structure 9, which functions as a supporting disc., i.e. is absorbing and compensating the shear forces between the compression dome 1 and the tension dome 2. The steel concrete structure 9 simultaneously can be formed as a building containing rooms e.g. for offices or the like.

For erecting the domed support structure according to FIGS. 1 to 3, first the girder elements 3 of the compression dome 1 are positioned on the ground and are connected to the purlins 7, the rafters 4, the transverse bars 5 and the compression sheating 6. Then this structure is lifted to the final height and the girders 3 are connected to the bearings 10. Thereafter, the tension dome 2 is also positioned on the ground, lifted and connected to the girder elements 3. When this is completed the domed support structure is slightly lowered again to an extent that the sheating 6 then transmits its own weight fully onto the bearings 10.

In the FIGS. 4 to 6 a second embodiment of the invention is illustrated. Whereas in the first embodiment according to FIGS. 1 to 3 the domed support structure is supported on bearings 10 along its ends in the longitudinal direction only the second embodiment is a domed support structure, which is supported along its four sides on walls 14. In this embodiment the compression and tension domes are no longer arranged side by side, but one above the other. Consequently, the domed support structure of FIGS. 4 to 6 comprises an upper compression sheating 11 and a tension sheating 12 arranged below, which especially can be seen in FIG. 4. The compression sheating 11 and the tension sheating 12 each from a catenary line in longitudinal direction. Like the girder elements 3 in the embodiment of the FIGS. 1 to 3, transverse beams 15 and vertical stiffening elements 16 stabilize the shape of the structure. The transverse beams 15 and the stiffening elements 16, however, transmit the net loads in two directions to the bearings 14 formed by the walls 14. The transverse beams 15 also define the curvature of the compression sheating 11 in transverse direction, as can be seen from FIG. 6. The tension sheating 12 is plane in transverse direction in the present embodiment (see FIG. 6), so that the domed support structure in bottom view is nearly plane. However, the construction can as well be such that the compression sheating 11 is plane in transverse direction, whereas the tension sheating 12 has a transverse curvature. For absorbing the shearing forces between the compression sheating 11 and the tension sheating 12, wedge shaped beams 18 are arranged at the longitudinal ends of the structure near the bearings 14. These wedge shaped beams 18 are connected to the sheatings by means of nail or bolt connections. The transverse beams 15 like in the first embodiment substantially do not support weight loads of the structure itself, but merely stabilize the shape of the structure.

Therefore, when erecting the structure, the transverse beams 15 are fixedly supported on the bearings or walls 14 only after the sheating fully is carrying its own weight.

Figure 7:
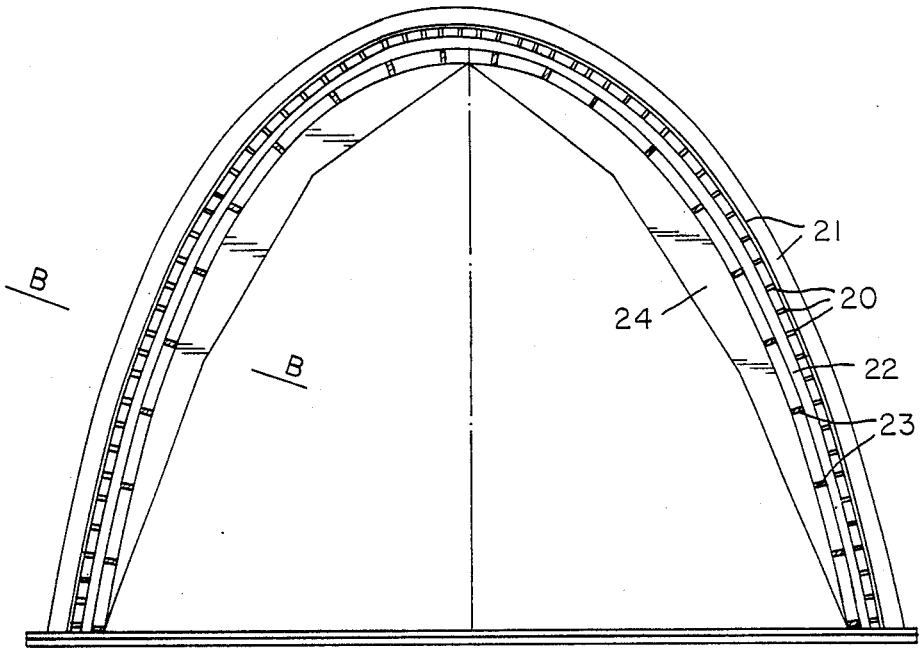
FIG. 7 is a longitudinal sectional view through a third embodiment of a domed support structure according to the invention.
Figure 8:
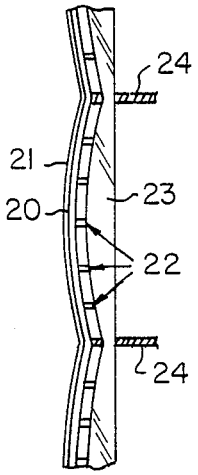
FIG. 8 is a transverse sectional view through a part of the support structure of FIG. 7 substantially taken along the line B—B in FIG. 7.
Figure 9:
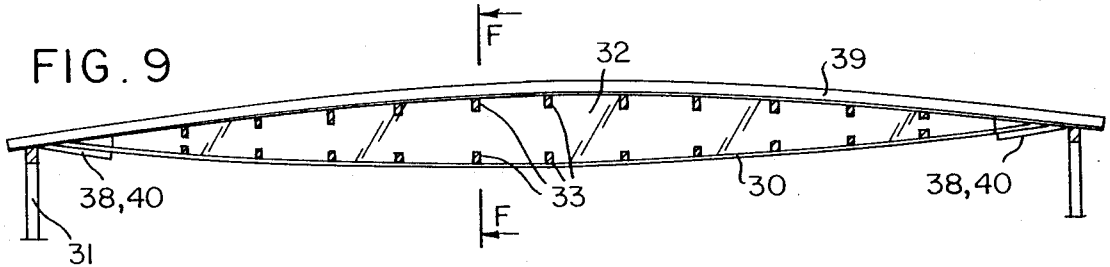
FIG. 9 is a longitudinal sectional view through a fourth embodiment of a domed support structure according to the invention.
Figure 10:
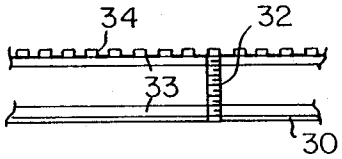
FIG. 10 is a transverse sectional view through a first version of the embodiment of FIG. 9 partly taken along the line F—F in FIG. 9.
Figure 11:
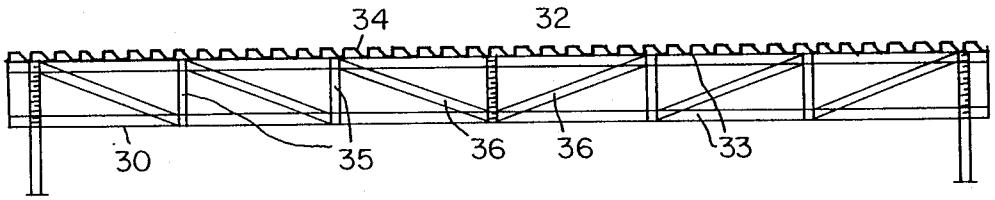
FIG. 11 is a transverse sectional view through a second version of the embodiment of FIG. 9, taken along the line F—F in FIG. 9.

By means of FIGS. 7 and 8 a third embodiment of the invention will be described now, which has the form of a wooden domed hangar roof. Similar to the structure of the first embodiment, a compression sheating 21 is connected by means of transverse bars 20 to rafters 22, which in turn are arranged on purlins 23. Girder elements 24 are arranged a specified distance from each other and are connected to the purlins 23. The girder elements 24 extend in longitudinal direction of the compression dome (which is not necessarily identical with the longitudinal direction of the hangar itself) and stabilize the catenary shape of the compression dome in this direction. The purlins 23 which extend transversely thereto define the curvature of the compression sheating 21 as can be seen from FIG. 8.

In the erected state the girder elements 24 and the purlins 23 substantially do not support the weight loads of the structure itself as in the afore mentioned embodiments, but only net weight loads resulting from the influence of wind, snow and the like. Therefore, the girder elements 24 and the purlins 23 have a relatively small cross section. The weight loads of the structure itself are transmitted by the rafters 22 and the compression sheating 21 directly to the bearings, which in the present case is the ground floor of the hangar.

Figure 14:
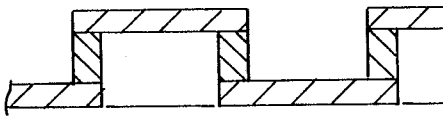
FIG. 14 is a transverse sectional view through a further version of the compression sheating of the embodiment of FIG. 9.
Figure 13:
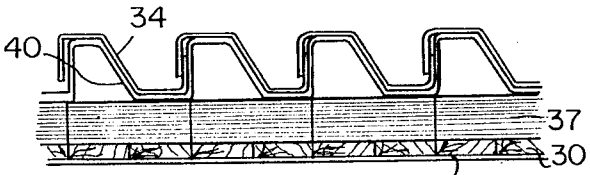
FIG. 13 is a transverse sectional view through the connection element of FIG. 12, substantially taken along the line G—G in FIG. 12.
Figure 12:
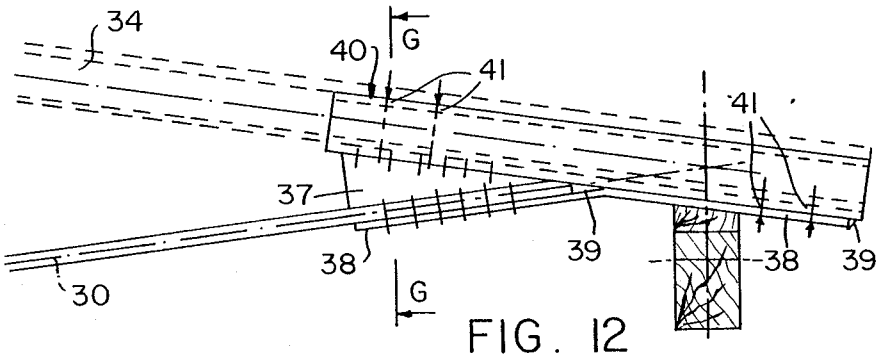
FIG. 12 is a longitudinal sectional view through a connection element of the embodiment of FIG. 9.

In a fourth embodiment of the invention as shown in FIGS. 9 to 13 the necessary buckling strength of the compression sheating is achieved by using sheet metal elements which are profiled in lengthwise direction. Such lengthwisely profiled sheet metal elements have the same function as the transverse curvature of the compression sheating of the other embodiments of the invention. In FIGS. 9 to 13 roof constructions are illustrated, in which the horizontal shearing force of the compression sheating 34 is compensated by a tension sheating 30 formed of tension tightly connected wooden boards forming a ceiling. The transmission of the own weight loads of the structure itself to the bearings 31 in this case is distributed between the tension and the compression sheating. If the structure is supported on two sides only (see FIG. 10) longitudinal girder elements 32 and transverse purlins 33 are provided for stiffening of the structure. The compression sheating 34 in this case is composed of longitudinally extending profiled sheet metal roof elements 34, which ensure the buckling strength of the structure. As shown in FIG. 14, in an alternative version the compression sheating can instead be composed of wooden elements 42 forming a lengthwise profiled sheating 34.

If the structure is supported on four sides (see FIG. 11) several cross sections of the structure can be provided with transverse load carrying supporting elements composed of upright elements 35 and struts 36 forming together part of a supporting deck and therefore participating partly in the transmission of the structure weight loads to the bearings. The domed support structures formed in this manner are composed of elements having small cross sections and weight loads, since the load forces are not concentrated, but are equally distributed over the entire surfaces of the compression and the tension sheating. In the bearing area, however, a connection element has to be provided for compensating the horizontal shear forces. To this end the tension sheating 30 is connected by means of anchoring nails to an underlying steel sheet metal element 38 (see FIGS. 12 and 13). The steel sheet metal element 38 is welded at 39 to an overlying connection profile 40. The profiled steel sheet metal elements 34 of the compression sheating then are connected thereto by means of screws, to which end the connection profile 40 and the steel sheet metal element 38 are provided with suitable bores 41. Between the compression and the tension sheating 30, 34 a wedge shaped element 37 is provided for defining the angle between said sheatings.

The domed support structure of the FIGS. 9–14 is economical for many applications. Especially, it comprises a walkable room between the roof 34 and the ceiling 30, which can be used for thermal insulation, for installations and for inspection of the structure.

The above described invention is advantageous compared with known structures since it allows the construction of wide-spanned domed support structures with only small connection forces between the elements. This, in turn, allows the use of wooden elements of relatively small cross sections and weight. Obviously, the same structure can also be built by means of steel elements.

While there are shown and described present preferred embodiments of the invention, it is to be understood that the invention is not limited thereto, but may be otherwise variously embodied and practised within the scope of the following claims.

Accordingly: What is claimed is:

1. A domed support structure comprising at least one compression dome arched in a first direction in a catenary line and extending between two opposite relatively spaced ends in said first direction, at least one tension dome also arched along said first direction in a catenary line and extending between said two ends, said tension dome being arranged below said compression dome, first bearing structure means arranged at said two ends for supporting said compression and said tension domes, a plurality of transverse beams extending in a second direction transverse to said first direction, said transverse beams having curved upper surfaces, said compression dome including individual elongated compression sheating elements extending along said first direction in a catenary configuration and additionally defining a curvature in said second transverse direction, said curvature corresponding to and being defined by said curved upper surfaces of said transverse beams, said tension dome including tension sheating arranged below said compression sheating of said compression dome, connection element means mounted between and connected to said compression sheating and said tension sheating for absorbing horizontal compression and tension forces of said compression and said tension sheating, respectively, and said connected compression and tension sheatings being supported at said two ends by said first bearing structure means.

2. The domed support structure as defined in claim 1 including stiffening elements extending in said first direction and connected between said compression sheating and said tension sheating, and said stiffening elements having an upper and a lower surface with a shape corresponding to said catenary lines of said compression and said tension domes, respectively.

3. The domed support structure as defined in claim 1 including second bearing structure means arranged at transverse ends of said compression dome for supporting said transverse beams.

4. The domed support structure as defined in claim 1 wherein said transverse beams have plane lower surfaces and the shape of said tension sheating in transverse direction is defined by said plane lower surfaces of said transverse beams.

5. The domed support structure as defined in claim 1 wherein said connection element means are wedged shaped beams arranged at said two ends between the compression sheating and the tension sheating.

6. The domed support structure as defined in claim 1 wherein said at least one compression dome and said at least one tension dome lie in a generally common vertical plane.

* * * * *